United States Patent [19]

Tanikawa

[11] Patent Number: 4,574,612

[45] Date of Patent: Mar. 11, 1986

[54] STROKE ADJUSTING MECHANISM OF BLIND NUT SETTING TOOL

[75] Inventor: Osamu Tanikawa, Toyohashi, Japan

[73] Assignee: USM Corporation, Farmington, Conn.

[21] Appl. No.: 612,398

[22] Filed: May 21, 1984

[30] Foreign Application Priority Data

May 27, 1983 [JP] Japan ..... 58-80002[U]

[51] Int. Cl.[4] ..... B21J 15/36

[52] U.S. Cl. ..... 72/391; 72/35

[58] Field of Search ..... 227/2, 52, 53, 55, 142; 72/35, 114, 391

[56] References Cited

U.S. PATENT DOCUMENTS 3,654,792 4/1972 Mead ..... 72/391 X 4,229,960 10/1980 Nilsson ..... 72/391 X 4,368,631 1/1983 Tanikawa ..... 72/391 X

FOREIGN PATENT DOCUMENTS 2274377 9/1976 France ..... 72/114

*Primary Examiner*—Paul A. Bell

*Assistant Examiner*—Taylor J. Ross

*Attorney, Agent, or Firm*—Alan N. McCartney

[57] ABSTRACT

In a motor driven tools for setting blind nuts, a threaded interconnection between a nose housing and a mast housing that provides an adjustment of the length of the setting stroke of the tool to accommodate various sizes of blind nuts. A locking member sets the adjustment and the mast housing is provided with indicating lines of the stroke depth.

3 Claims, 7 Drawing Figures

STROKE ADJUSTING MECHANISM OF BLIND NUT SETTING TOOL

BACKGROUND OF THE INVENTION (1) Field of the Invention

The present invention relates to a blind nut setting tool, and particularly to a blind nut setting tool that can adjust a setting stroke of a blind nut.

(2) Summary of the Prior Art

Motor-driven tools for setting blind nuts have conventionally been known. These tools comprise a mandrel having a front end externally threaded with a pulling rod connected to the rear end of the mandrel and having an externally threaded rear portion. A nut member is screwed to the externally threaded portion of the pulling rod and there is means to rotate the nut member. A cylindrical mast housing extends from the tool body forwardly so as to enclose the nut member and a rear portion of the pulling rod. A cylindrical nose housing is screwed to the front end of the mast housing and extends from the mast housing forwardly so as to enclose the pulling rod and a rear portion of the mandrel. A nose portion encloses the mandrel with the external thread of the mandrel projected and adapted to be slidable in the axial direction of the nose housing but unrotatable to the nose housing. The mandrel is rotated by a rotation of the nut member so that the external thread at the front end of the mandrel is screwed into the blind nut. Subsequently the rotations of the mandrel and the pulling rod are stopped by a contact between a flange of the blind nut and a front end surface of the nose portion so that the tool body moves forwardly by a predetermined length relative to the nose portion. Then, the mandrel is retracted rearwardly by a predetermined stroke so as to expand a tubular portion of the blind nut to be set to a panel.

In such a blind nut setting tool, as described adjustment of a setting stroke is effected by adjusting a distance between the rear end surface of the flange of the nose piece of the nose portion and the front end surface of the nose housing by means of a nut. The stroke adjustment is also possible by moving the nose housing axially. However, such methods of adjustment require steps to measure the distance with a gauge or the like and to calculate a stroke corresponding to the distance, these steps being troublesome and quite time-consuming.

BRIEF SUMMARY OF THE INVENTION

Accordingly, the object of the present invention is to facilitate adjustment of a setting stroke in the blind nut setting tool.

In order to accomplish such an object, the blind nut setting tool according to the present invention is characterized in that a screw connection portion between the nose housing and the mast housing is provided with an indication portion formed with indicating lines showing screwing depths. There is a member to lock the rotation of the nose housing screwed into the mast housing relative to the mast housing. The indicating lines are engraved in accordance with the stroke lengths.

Being constructed as described above, a stroke length can be known by looking at the indicating lines in the indication portion, and adjustment of the stroke length can be made extremely easily.

The lock member may be formed as a lock nut or may be composed of a collar and a spring. Anyhow, it can lock the nose housing so as not to rotate with respect to the mast housing and by releasing the locking, the nose housing can be inserted into or pulled out of the mast housing so that stroke adjustment can be easily effected. The indication portion may be formed either directly in the lock member or the mast housing or independently as a scale. It is preferable to provide a plurality of indication portions according to the sizes of bind nuts whereby a proper stroke can be determined for any of blind nut sizes and panel thicknesses.

DESCRIPTION OF THE PREFERRED EMBODIMENTS

Figure 1:
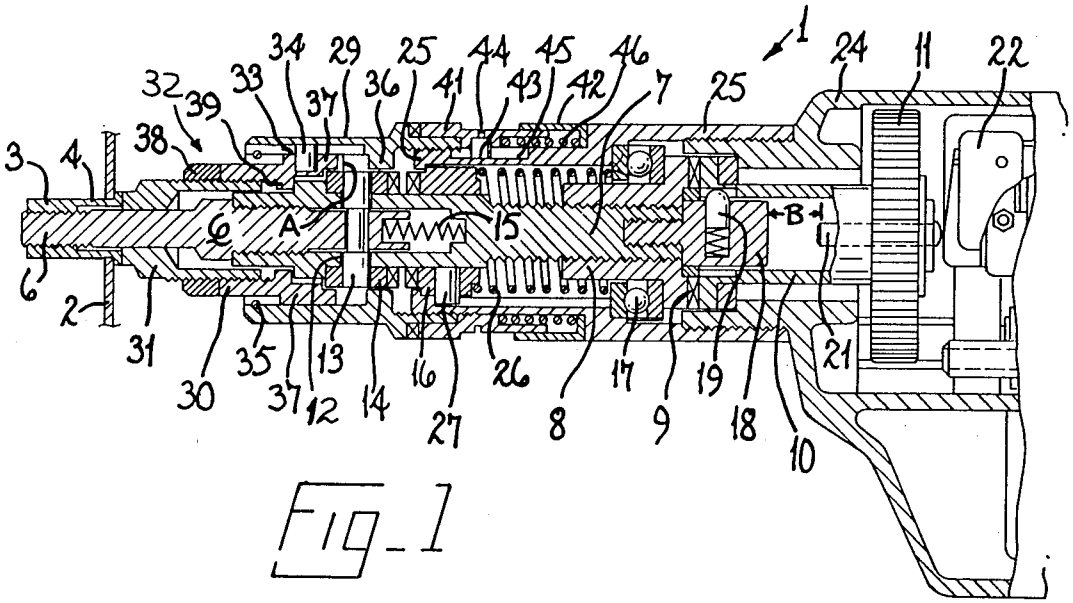
FIG. 1 is a sectional view showing an embodiment of a blind nut setting tool according to the present invention.
Figure 3:
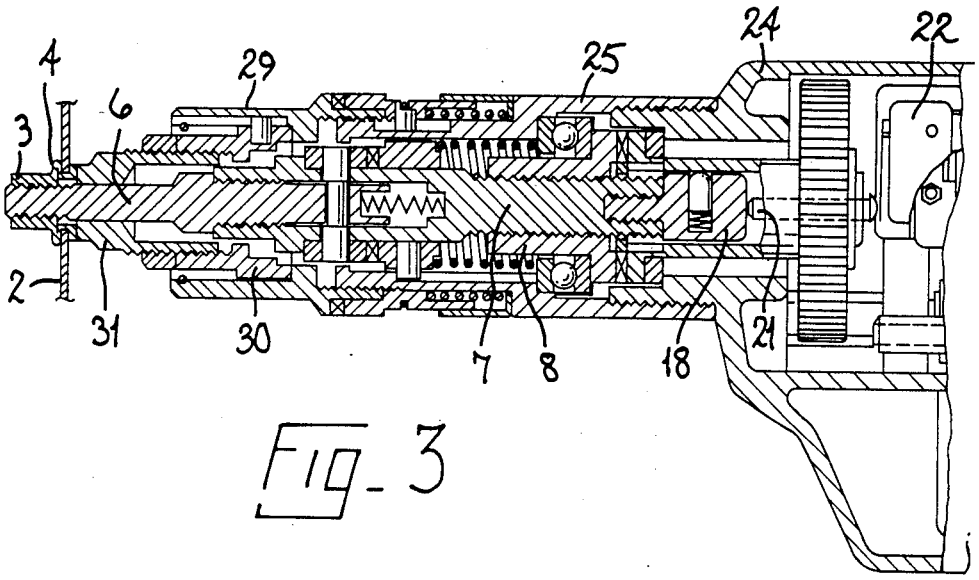

The present invention is further described by way of an embodiment, with reference to accompanying drawings. FIG. 1 shows a blind nut setting tool according to the present invention. The tool 1 operates to set a blind nut 3 to a panel 2 of a predetermined thickness by expanding the diameter of a tubular portion 4 of the blind nut 3 (FIG. 3).

The blind nut setting tool 1 is provided with a mandrel 6 which is externally threaded at the front end. A pulling rod is connected to the rear end of the mandrel and is formed with an external thread at a rear portion thereof. A nut member 8 is screwed on to the externally threaded portion of the pulling rod. The nut member 8 is adapted to be driven through a clutch 9, a spindle 10 and a gear 11 by a motor (not shown). The rear end portion of the mandrel 6 is screwed on to the front end portion of the pulling rod 7. The pulling rod 7 is provided with a hole 12 which carries a pin 13. A clutch member 14 is attached to the pin 13. The pin 13 is pushed forward by a spring 15 so as not to engage a clutch member 16. The nut member 8 is freely rotatably mounted in a bearing 17. A stopper 18 is fixed to the rear end of the pulling rod 7. The stopper 18 is provided with a pin 19 extending radially outwardly. The pin 19 is adapted to be fitted into a groove formed on an inner surface of the spindle 10 so as to form an overload clutch. The spindle 10 is provided with a guide pin 21 extending toward the stopper 18. The rear end of the guide pin 21 is adapted to press a lever of a limit switch 22. As shown in FIG. 3, when the rear end of the stopper 18 presses the guide pin 21, the limit switch 22 is resiliently biased to reverse the rotation of the motor.

Housings are provided forwardly from a tool body 24 to enclose the above-described structure. The first of such housings is a cylindrical mast housing 25 enclosing the nut member 8 and the rear half portion of the pulling rod. The mast housing 25 is fixed to the tool body 24.

Inside the front end of the mast housing 25, is a shoulder adapted to stop a forward movement of the clutch member 16. The bearing 17 is fixed to a mid portion of the mast housing 25. A spring 26 is interposed between the clutch member 16 and the bearing 17 to press the clutch member 16 forwardly. The clutch member 16 is provided with a pin 27 which, engages a longitudinal groove on the inner surface of the mast housing 25 to enable the clutch member 16 to move backwardly without rotating.

The front end of the mast housing 25 is screwed onto a cylindrical nose housing 29 which extending from the mast housing 25 forwardly to enclose a front portion of the pulling rod 7 and the rear portion of the mandrel 6. When the nose housing 29 rotates relative to the mast housing, because of a screw connection of the two housings, the nose housing 29 is extended forwardly or rearwardly.

In the screw connection portion between the nose housing 29 and the mast housing 25, a setting stroke adjustment mechanism is accomplished, which will become apparent hereinafter.

The front portion of the nose housing 29 is connected to a nose portion 32 comprising a collar 30 and a nose piece 31. The nose portion 32 encloses the pulling rod 7 and the mandrel 6 and is rotatable axially within the nose housing 29. The nose piece. 31 rotatably supports the mandrel 6. The collar 30 has a hole 33 into which a pin 34 is positioned to prevent rotation of collar 30. A forward movement of the collar 30 is restricted by a ring 35 provided in the nose housing 29. Rearward movement of the collar 30 is restricted by a reduced diameter portion 36 of the nose housing 29. The reduced diameter portion 39 of collar 30 comes in contact with a tiered portion 37 of the pulling rod 7 to retract the pulling rod 7. A lock nut 38 locks the collar 30 to the nose piece 31.

The operating sequence of the blind nut setting as described above will be explained with reference to FIG. 1 through FIG. 3. Under the normal condition, when the motor is rotated by pulling a trigger (not shown in the drawings), the nut member 8 is rotated by the gear 11, through the spindle 10 and the clutch 9. This rotation is transmitted through the pin 19 and the stopper 18 to the pulling rod 7 to rotate the mandrel 6 connected to the pulling rod 7. When the external thread of the mandrel 6 is inserted into the blind nut 3 fitted to the panel 2, the mandrel 6, by its rotation, continues to screw into the nut 3 until the flange of the nut 3 comes in contact with the end surface of the nose piece 31.

When the flange of the nut 3 comes in contact with the end surface of the nose piece 31, the rotation of the mandrel 6 and pulling rod 7 is stopped which disengages the pin 19 of the stopper 18 from the groove of the spindle 10. The nut member 8 continues to rotate placing a rearward force on pulling rod 7. This rearward force on pulling rod 7 will move the nose housing 29, mast housing 25 and tool body 24 forward until the space A between the reduced diameter portion 36 and tiered portion 37 is closed.

Figure 2:
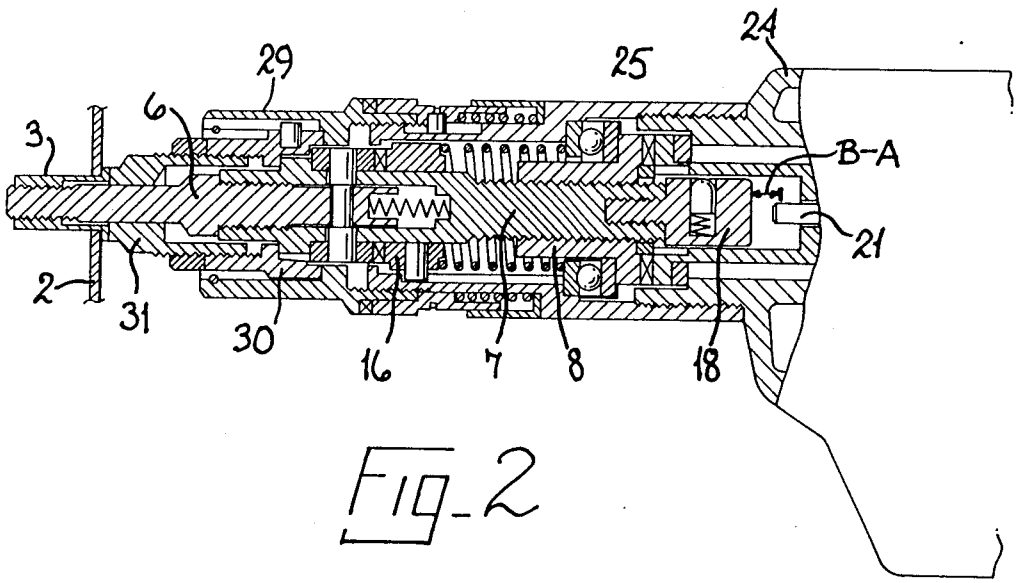
FIGS. 2 and 3 are sectional views showing operating conditions of the above tool.

When the tool moves forwardly by a length corresponding to the space A, the rear end surface of the tiered portion 37 of the collar 30 comes in contact with the front end surface of the small diameter portion 36 of the nose housing 29, (see FIG. 2), and the clutch members 14 and 16 engage so that the mandrel 6 and the pulling rod 7 stop their respective rotations completely. At that time, a distance B (see FIG. 1) which existed between the rear end surface of the stopper 18 and the switch 22 is reduced to a distance B−A as shown in FIG. 2. As the nut member 8 continues to rotate the pulling rod 7 and the mandrel 6 move rearwardly with strong force to start gradually expanding the tubular portion 4 of the blind nut 3. When the rear end surface of the stopper 18 pushes the guide pin 21 to contact the switch 22, the blind nut 3 is tightly fixed to the panel 2 as shown in FIG. 3. When the limit switch 22 is actuated, the motor reverses to return the pulling rod 7 and the mandrel 6 to the forward positions and withdraw the threaded end of mandrel 6 from the nut.

As described above, the distance B shown in FIG. 1 signifies a total stroke throughout the process to push the tool body forwardly by means of the pulling rod 7 (and eventually the mandrel 6), to draw it back and to reverse the motor. The space A signifies a stroke for the tool body to be pushed forward. The space A is a stroke value not contributing to setting of the blind nut. Accordingly, as shown in FIG. 2, the setting stroke is obtained by B −A. The distance B is a length determined by manufacturing and assembling of the tool and a fixed value. However, the space A can be changed by axially moving the nose housing 29 with respect to the collar 30. Since in the normal condition of the tool, a rearward movement of the collar 30 is restricted by a contact of the small diameter portion 39 of the collar 30 with the shoulder of the pulling rod 7, the collar 30 is not movable. In order to change a value of the space A, the nose housing 29 should be rotated relative to the mast housing 25 to move the nose housing 29 axially with respect to the collar 30.

The setting stroke varies according to the thickness of a panel to which a blind nut is set, and also according to the size of the nut. For convenience sake, explanation will be given for a case in which the setting stroke is variable according to six thicknesses a through f (see FIGS. 5 and 6).

For the purpose of facilitating the adjustment of the setting strokes, according to the present invention, a collar 41 and a scale 42 are provided in the screw connection portion between the nose housing 29 and the mast housing 25 as illustrated in FIG. 1 through FIG. 4. The collar 41 contacts a pin 43 which is pushed inwardly by a ring 44. The pin 43 is fitted longitudinal groove 45 formed in the mast housing 25 so as to be axially slidable but not rotatable relative to the mast housing 25. The collar 41 contacts a spring 46 provided between a tiered portion on the inner side thereof and the scale 42 (or the mast housing 25) so that the collar 41 is pressed against the nose housing 29. The collar 41 is formed with a longitudinal portion 47 and the end surface of the hose housing 29 is formed with a recess portion 48 complementary to the longitudinal portion 47 so that their interlocking prevents the nose housing 29 from rotating, with the collar 41 functioning as a lock member. The scale 42 is so disposed as to enclose the collar 41 and is kept in contact with the mast housing 25 with a certain degree of frictional force by means of a spring 46. The scale 42 is formed with a window 49 on the surface thereof and engraved with six indicating lines 50 indicating stroke lengths corresponding to the space A in FIG. 1 in accordance with panels a–f shown in FIG. 6. Preferably, a plurality of windows 49 are formed round the scale 42 and it is also preferable to provide indicating lines showing stroke lengths respectively corresponding to the sizes of blind nuts. In the event the indicating line is hard to be seen, the scale 42 can be rotated to a better position because the scale is not fixed to the mast housing. Reference lines 51 are formed circumferentially on the collar 41 for indicating stroke length corresponding to the reference lines 50.

Figure 4:
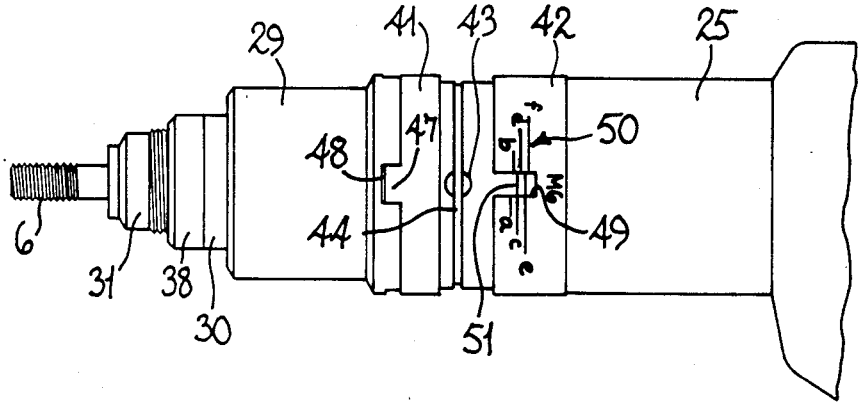
FIG. 4 is a side view of the tool of FIG. 1.
Figure 5:
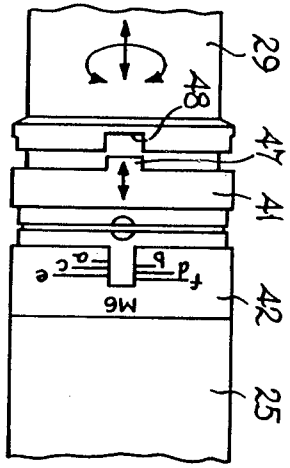
FIG. 5 is an explanatory illustration of operation of a setting stroke adjustment mechanism according to the present invention.
Figure 6:
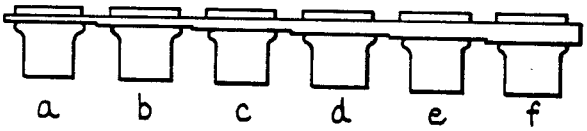
FIG. 6 is a side view showing blind nuts set to panels having various thicknesses.

In the above structure, for changing stroke lengths, as shown in FIG. 5, by moving the collar 41 toward the mast housing 25 and removing the locking of the nose housing 29 to rotate the nose housing relative to the mast housing 25, the space A in FIG. 1 can be varied. When the rotation ends, by releasing the collar 41, the collar 41 moves so that the longitudinal portion 47 fits into the recessed portion 48 of the nose housing 25 and the condition shown in FIG. 4 is restored. At that time, if the reference line 51 indicates the indicating line of a predetermined panel thickness, a correct setting stroke can be obtained. Accordingly, adjustment for the required setting stroke is known by sight and the adjustment can be made very easily.

Figure 7:
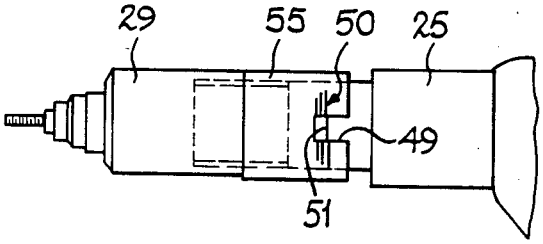
FIG. 7 is a side view of another embodiment of a blind nut setting tool according to the present invention.

For fine adjustment, a number of longitudinal portions 47 and recessed portions 48 can be formed or the respective ends can be made in wave forms. The lock member is not limited to the above-mentioned collar but any other members, for example, a lock nut can be used. The scale is not necessarily formed separately from he mast housing but the indication portion can be formed directly on the mast housing. FIG. 7 shows an example in which a lock nut 55 is used as the lock member and the reference lines 51 are formed directly on the mast housing 25. Comparing to the first embodiment described earlier, this embodiment is disadvantageous in that the indication window cannot be rotated to a desired position, however, it is advantageous since the number of parts can be reduced.

I claim:

1. A blind nut setting tool having a body, and comprising a mandrel having an externally threaded front end, a pulling rod connected to the rear end of said mandrel, said pulling rod having an externally threaded rear portion, a nut member threaded to said pulling rod rear portion, means to rotate said nut member, a cylindrical mast housing extending from the tool body and extending forwardly to enclose said nut member and said pulling rod, a cylindrical nose housing rotatably connected to said mast housing and enclosing said mandrel, a nose portion slidably disposed in said nose housing and rotatably supporting said mandrel, said mandrel being rotated by said nut member so that said mandrel is threaded into the blind nut until said nose portion contacts the blind nut, whereby rotation of said pulling rod and said mandrel ceases; additional rotation of said nut member causing said pulling rod and said mandrel to retract into said nose portion and said mast housing to set the blind nut, said rotatable connection of said nose housing to said mast housing being selectively adjustable to vary the depth of retraction of said pulling rod and said mandrel into said nose portion and said mast housing, said mast housing having indicia indicating the adjustment position of said nose housing to indicate the depth of retraction of said pulling rod and said mandrel, and means to lock said nose housing to said mast housing in various positions of adjustment.

2. The tool set forth in claim 1 wherein the locking means is a lock nut provided between said nose housing and said mast housing.

3. The tool set forth in claim 1 wherein the locking means comprises a collar disposed between said nose housing and said mast housing, and spring means positioned between said mast housing and said collar for pressing the collar against said nose housing.

* * * * *